US006296062B1

(12) United States Patent
Sundholm

(10) Patent No.: US 6,296,062 B1
(45) **Date of Patent: *Oct. 2, 2001**

(54) INSTALLATION FOR EXTINGUISHING FIRE, SPRAY HEAD

(76) Inventor: Göran Sundholm, Ilmari Kiannon kuja 3, FIN-04310 Tuusula (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/538,437

(22) Filed: Mar. 29, 2000

(30) Foreign Application Priority Data

Oct. 8, 1999 (FI) ..... 19992172

(51) Int. Cl.[7] ..... A62C 37/08

(52) U.S. Cl. ..... 169/37; 169/38; 169/39; 169/41; 169/42; 169/56; 169/57

(58) Field of Search ..... 169/37, 38, 39, 169/41, 42, 54, 56, 57

(56) References Cited

U.S. PATENT DOCUMENTS

| | | | | |
|---|---|---|---|---|
| 399,519 | * | 3/1889 | Grinnell | 169/37 |
| 515,938 | * | 3/1894 | McLauthlin et al. | 169/37 |
| 2,327,528 | * | 8/1943 | Kendall et al. | 169/37 |
| 2,389,331 | * | 11/1945 | Tyden | 239/37 |

FOREIGN PATENT DOCUMENTS 9310860 6/1993 (WO) .

* cited by examiner

*Primary Examiner*—David A. Scherbel
*Assistant Examiner*—Robin O. Evans
(74) *Attorney, Agent, or Firm*—Ladas & Parry

(57) ABSTRACT

The invention relates to an installation for extinguishing fire, the installation comprising a number of spray heads (330*a*, 380*a*), a pipe system (381) for leading extinguishing medium to the spray heads, which spray heads comprise a holder body having an inlet for incoming extinguishing medium and at least one nozzle. In order to be able to use the installation in conditions in which it can be strongly exposed to dirt and impurities and in order that it will not be activated on account of the spray heads of the installation being exposed to impacts or heat not coming from the seat of the fire, the installation is characterized in that the spray heads (330*a*, 380*a*) comprise a cover, which is positioned by means of a locking device in a protective position in front of said nozzle when the installation is in an inactive mode and which is, upon activation of the installation, arranged to be displaced to a free position, in which the cover is out of the way of said nozzle, the cover being arranged to be displaced to the free position when a fluid exerts a force against the locking device so that this opens.

20 Claims, 13 Drawing Sheets

Automatic Nozzle with cover release

Open Nozzle with cover release for Flash over prevention

Fire detector

INSTALLATION FOR EXTINGUISHING FIRE, SPRAY HEAD

BACKGROUND OF THE INVENTION

The invention relates to an installation for extinguishing fire, the installation comprising a number of spray heads, a pipe system for leading extinguishing medium to the spray heads, the spray heads comprising a holder body having an inlet for incoming extinguishing medium and at least one nozzle. The installation can be used both in open and closed spaces.

The invention relates further to a combination of a means of transportation and an installation for extinguishing fire. The expression means of transportation refers here to all kinds of vehicles, such as trains, lorries, ships as well as semitrailers, such as railway wagons (especially open ones) and trailers (especially open ones) for these vehicles.

The invention relates also to a combination of a tunnel and an installation for extinguishing fire.

The invention relates further to a spray head comprising a holder body, an inlet for incoming extinguishing medium and at least one nozzle.

One of the greatest problems with fire fighting installations is to make the fire detection synchronized with the actual fire extinction in such a way that the fire extinction occurs as fast as possible at the site of the fire.

An installation for extinguishing fire is known from WO 93/10860. This installation comprises a number of spray heads arranged in groups in such a way that each group comprises a number of spray heads. A spray head of each particular group comprises a heat-activated release means. When this melts or explodes on account of heat, the installation is arranged to deliver extinguishing medium to the other spray heads of the group. The other groups do not release. In order to make a further group release, the release means of this further group has to explode or melt. This known construction enables spraying extinguishing medium to a limited area in the vicinity of the fire without extinguishing medium being sprayed in areas with no fire, and in this manner, it is possible to manage with a relatively small amount of extinguishing medium.

This known installation normally functions well. However, there are environments where an installation of this kind does not function satisfactorily or cannot function at all. In this connection, reference is made e.g. to environments where the spray heads are exposed to dirt, deposits and impurities of different kinds leading to the fact that the components of the spray heads, such as nozzles and heat-activated means, cannot function (the nozzles are blocked; the heat-activated release means do not function satisfactorily, because they respond poorly to the heat from fire, since they are very dirty). An example of such an environment is e.g. an open railway wagon. Open railway wagons are used for transporting vehicles and other equipment and goods that can be inflammable and thus constitute a fire risk. If a conventional fire fighting installation were installed in an open railway wagon, it would become too dirty to function in a relatively short time. Even in covered railway wagons (and trailers), such goods can be transported which very quickly make the railway wagon (trailer) dirty, and therefore, the present invention can also be applied to covered railway wagons (and trailers). Other examples of such environments are painter's shops and steel works.

In certain environments, e.g. railway wagons, tunnels, car decks, high storage, where the fire may develop fast, it is desirable to control the fire in such a way that not too big an area is covered by releasing sprinklers. To divide the installation into sections, as shown in WO 93/10860, is not a sufficient solution for providing effective fire extinction, because in such environments, sprinklers release also in irrelevant sections (sections with no fire). A fire fighting installation with a known structure and mounted in a means of transportation, such as an open railway wagon, would thus in any case function unreliably for that reason alone that, because of wind conditions, hot gases generated at fire flow fast to such areas where there is no fire at all, the consequence being that extinguishing medium is delivered to a wrong area, i.e. an area with no seat of fire. This leads to a loss of extinguishing medium and constitutes an essential drawback in an application to a means of transportation, because vehicles have a limited capacity of transporting extinguishing medium, in practice. Further, delivering extinguishing medium to a "wrong" area may result in material damages. A typical example is constituted by a train driving at a speed of 140 km/h when a fire breaks out. The heat from the fire spreads and the ampoules of the sprinklers explode at a place far from the actual fire, which leads to that extinguishing medium, such as water, is sprayed to a wrong place. In tunnels and garages, hot exhaust gases from lorries can be directed straight up towards sprinklers, which also results in that sprinklers release without a fire or even without a risk of fire.

On the basis of this, these difficult environments in many cases lack fire fighting installations, in spite of that a functioning fire fighting installation would be of great use.

Mechanical loads can also make a fire fighting installation function unnecessarily (especially in case of a breakage of the release means of the installation). Such mechanical loads may arise at impacts by trucks, lorries, etc.

There are also fire fighting systems in which the pipes leading to the sprinklers initially contain no water, which depends on the risk of freezing or on weight problems. It takes a certain time (typically 60 s) to fill the pipes and a fire broken out quickly may release too many sprinklers before the water reaches the sprinklers. Examples of environments where the fire may develop quickly are ships transporting vehicles: a fire on a ship deck may spread quickly.

In certain environments, there is a risk that the fire starts explosively. In such an environment, it is probable that all ampoules of a fire fighting installation release by the pressure of the explosion, which makes it impossible for the installation to function effectively to fight the fire. Examples of the last-mentioned environments are transformers, paint cabinets and paint stores.

BRIEF DESCRIPTION OF THE INVENTION

The object of the invention is to provide an installation for extinguishing fire, which installation essentially decreases said problems and can be mounted in difficult environments, where the spray heads are exposed e.g. to dirt, deposits, mechanical impacts and wind conditions, which makes a release of spray heads, important for the extinction, more difficult or impossible.

For this purpose, the present invention provides an installation for extinguishing fire, the installation comprising a number of spray heads, a pipe system for leading extinguishing medium to the spray heads, the spray heads comprising a holder body having an inlet for incoming extinguishing medium and at least one nozzle, wherein the spray heads comprise a cover, positioned by means of a locking device in a protective position in front of said nozzle when the installation is in an inactive mode and, upon activation of the installation, arranged to be displaced to a free position by opening the locking device, in which free position the cover is out of the way of said nozzle so that the nozzle may spray extinguishing medium when the spray head is in an active mode, the cover being arranged to be displaced to the free position by a pressure medium exerting a force on the locking device so that it opens.

The idea of the installation according to the invention is that it comprises spray heads provided with covers preventing extinguishing medium from being sprayed until the cover has been removed manually or by means of a signal from a fire detector (e.g. a smoke or heat detector responding to surface or radiation heat, or an optical detector), the cover functioning (before it is removed) at the same time as a protection against dirt, dust and deposits, if desired. The spray heads cannot be made to spray merely by subjecting them to heat. Before the spray heads release, the detectors give a signal or, alternatively, the spray heads are activated manually, which pressurizes an activation system.

According to an especially preferred embodiment, part of said spray heads are sprinklers comprising a heat-activated release means and part of the spray heads are without a heat-activated release means (open nozzle spray heads). When the cover is displaced to the free position, these sprinklers are arranged to enter a standby mode, where the heat-activated release means is intact to be able to respond to heat and to provide thus a release of the sprinkler in question and to bring it to an active mode, where it sprays extinguishing medium. At detection of a fire, such an installation is capable of giving off extinguishing medium immediately to the area/areas where the probability of fire is great and it is also adapted to strengthen the spraying of extinguishing medium at certain "points" when the temperature at these "points" rises high enough.

Preferred embodiments of the installation are set forth in attached claims 2 to 16.

The greatest advantages of the installation are that it can be used in difficult environments, where the spray heads are exposed to dirt and impurities. This is because the installation is capable of functioning reliably, though it has been exposed to dirt for a long time. The installation uses only little extinguishing medium, because extinguishing medium is given off (discharged) only at places where it is needed. For instance, sprinklers in tunnels, garages etc. are thus not released by hot exhaust gases of lorries, which gases can be directed straight up towards these sprinklers and could so make the installation function unnecessarily. The spray heads of the installation are also protected against mechanical loads. In such cases, the cover of the spray head prevents a release to a great extent. In environments with risk of explosion as well, the spray heads are prevented from releasing unnecessarily.

The present invention provides a combination of a means of transportation and an installation for extinguishing fire, wherein a number of spray heads and a pipe system for leading extinguishing medium to the spray heads are provided, the spray heads comprising a holder body, at least one nozzle, a cover, positioned by means of a locking device in a protective position in front of said nozzle when the installation is in an inactive mode and, upon activation of the installation, arranged to be displaced to a free position by opening the locking device, in which free position the cover is out of the way of said nozzle so that the nozzle may spray extinguishing medium when the spray head is in an active mode, the holder body comprising an inlet for incoming extinguishing medium, the cover being arranged to be displaced to the free position by a pressure medium exerting a force against the locking device so that it opens.

The greatest advantages of the combination are that extinguishing medium is given off in case of fire only at places where it is needed and the installation is capable of functioning reliably though it has been exposed to dirt for a long time. The first-mentioned property is also extremely important, because a vehicle cannot carry very big amounts of extinguishing medium, in practice. In vehicles, the aim is to minimize the amount of extinguishing medium in every possible way for that reason alone that it is energy consuming and expensive to transport big amounts of extinguishing medium.

The present invention provides a combination of a tunnel and an installation for extinguishing fire, wherein a number of spray heads and a pipe system for leading extinguishing medium to the spray heads are provided, the spray heads comprising a holder body, at least one nozzle, a cover, positioned by means of a locking device in a protective position in front of said nozzle when the installation is in an inactive mode and, upon activation of the installation, arranged to be displaced to a free position by opening the locking device, in which free position the cover is out of the way of said nozzle so that the nozzle may spray extinguishing medium when the spray head in an active mode, the holder body comprising an inlet for incoming extinguishing medium, the cover being arranged to be displaced to the free position by a pressure medium exerting a force against the locking device so that it opens. The greatest advantages of the combination are that extinguishing medium is given off in case of fire only at places where it is needed, though the installation has been exposed to dirt for a long time. Attached claim 20 defines a construction implying substantial savings in costs.

The present invention provides a spray head comprising a holder body, an inlet for incoming extinguishing medium and at least one nozzle, wherein a cover is provided, said cover being positioned by means of a locking device in a protective position in front of said nozzle when the spray head is in an inactive mode and, upon activation of the installation, being arranged to be displaced from said protective position to a free position by opening the locking device, in which free position the cover is out of the way of said nozzle so that the nozzle may spray extinguishing liquid when the spray head is in an active mode, the spray head comprising a device displaceable in relation to the spray head, which device is arranged to exert a force by means of fluid pressure against the locking device so that it opens.

Such a spray head is protected against dirt and deposits, and therefore, it is capable of functioning reliably also in an dirty environment, though it has been installed long time ago. Nozzles and other components are protected against dirt, dust and other material which could spoil the properties of the spray head to respond to a fire or to deliver extinguishing medium, and it can be brought into a standby mode/active mode without being activated by heat. The cover protects also against mechanical impacts. An activation of the spray head from the inactive mode to the standby mode/active mode can be implemented very quickly in different manners, without a short exposition to a heat transported by the wind from a remote fire causing an undesired pre-activation, which would lead to that extinguishing medium would be delivered to undesired places where there is no fire. In practice, no heat directed to the spray head causes the cover to be displaced to the free position, but the displacement is provided by fluid pressure;

on the other hand, the fluid pressure may be provided manually or in many different ways by means of a fire detector responding e.g. to surface or radiation heat, or by means of an optical flame detector. The fire detector gives a signal, which e.g. starts a pump in order to deliver fluid to the spray head, or gives a signal to a valve, which opens in order to deliver fluid (extinguishing medium) to the spray head.

BRIEF DESCRIPTION OF THE DRAWINGS

In the following, the invention will be described with reference to the attached drawing, where.

DETAILED DESCRIPTION OF THE INVENTION

Figure 1:
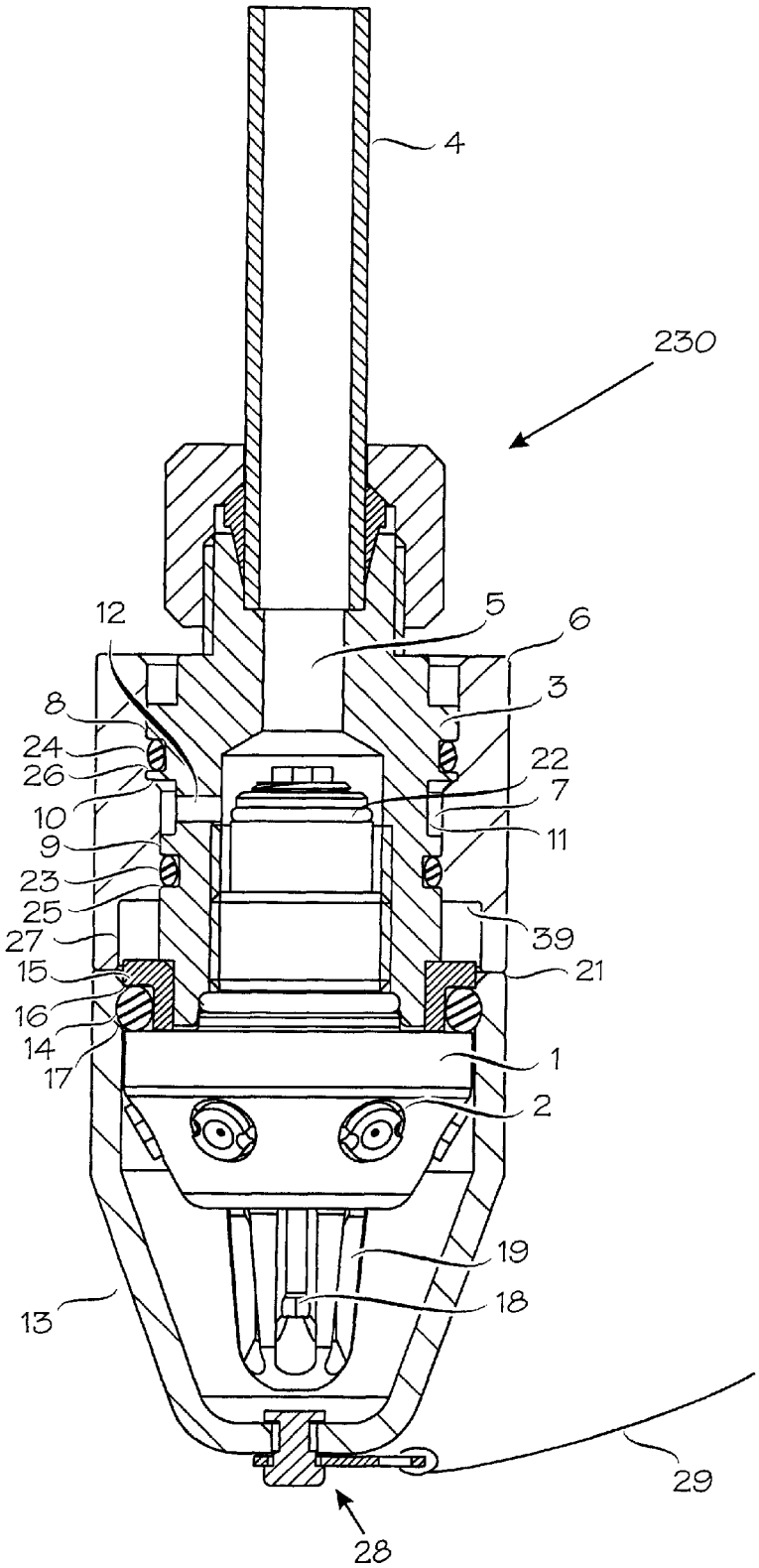
FIG. 1 shows a sprinkler according to the invention in a first inactive mode.

FIG. 1 shows a sprinkler 230 of the invention in a first inactive mode. The sprinkler comprises a nozzle body 1 and a glass ampoule 18, mounted at the nozzle body by means of a holder 19. The nozzle body 1 comprising a number of nozzles 2 is mounted by means of a screw joint to a holder body 3, which again is mounted to a conduit 4 delivering extinguishing medium to an inlet 5 of the holder body 3 and further to the upper portion 22 of the nozzle body.

The holder body 3 is surrounded by a cylindrical sleeve part 6. The sleeve part 6 is displaceable in relation to the holder body 3. Between the sleeve part 6 and the holder body 3, there is a pressure chamber 7. The pressure chamber 7 is formed between the holder body 3 and the sleeve part 6. The pressure chamber 7 is defined by a ring groove 11 made in the holder body 3 and by a first cylindrical inner surface 9 and a second inner surface, comprising the cylindrical surface 9 of the sleeve part 6. The diameter of the second inner surface 8 is bigger than the diameter of the first cylindrical inner surface 9. The transition between the surfaces 8 and 9 defines a shoulder 10.

The pressure chamber 7 is in contact with the inlet 5 over a passage generally indicated by reference numeral 12.

The sleeve part 6 is sealed against the holder body 3 by means of a first ring seal 23 at the first cylindrical inner surface 9 and a second ring seal 24 at the second cylindrical inner surface 8. The ring seals 23, 24 are mounted in corresponding ring grooves 25 and 26 in the holder body 3. Thanks to this, the construction is simple. The sleeve part 6 comprises corresponding, but shallow ring grooves for the ring seals 23, 24, the grooves being situated in the first cylindrical inner surface 9.

The sprinkler comprises a cover 13 in the form of a cup, which covers the glass ampoule 18 and the nozzles 2 and is by means of a ring seal 14 mounted against a flange-like part 15, which again is fastened to the holder body 3. The flange-like part 15 forms a ring groove 16 for the ring seal 14. The cover 13 comprises a cylindrical groove 17 for receiving the ring seal 14. The ring seal 14 will preferably be slightly pressed between the ring groove 16 and the cylindrical groove 17. It can be said that the cylindrical groove 17 together with the ring seal 14 constitute a locking device keeping the cover 13 in place in protective position. Because of the press force against the ring seal 14, the cover 13 will not only be steadily mounted at the sprinkler, but also attends to that important components of the sprinkler, such as the nozzles 2 and the glass ampoule 18, are protected against and hermetically closed from the environment of the sprinkler. This is important, because the sprinkler is intended to be used in different environments, where it is exposed to dirt, which makes the sprinkler unusable and its function unreliable without this cover 13.

In FIG. 1, the cover 13 is in protective position, where it also serves as a thermal shield preventing the ampoule 18 from exploding undesirably e.g. on account of a short hot gas flow against the sprinkler, e.g. from exhaust manifolds of lorries, which would result in the sprinkler causing a loss of extinguishing medium without a fire in the vicinity of the sprinkler. In case of fire, such a hot air flow may arise e.g. when the sprinkler is mounted in a means of transportation, such as an open railway wagon.

By pre-activation, the sprinkler of FIG. 1 can be brought into a standby mode by feeding pressurized fluid from the conduit 4 into the passage 12. A fluid pressure is then generated on the shoulder 10, the pressure providing a force trying to press the sleeve part 6 downwards. The strength of the force is determined by the product of the fluid pressure and the projected ring surface defined by the shoulder 10 and seen in the longitudinal direction of the holder body (i.e. conduit 4). When the strength of the force exceeds the force needed for opening the locking device constituted by the ring seal 14 and the groove 17, the cover 13 is detached from the ring seal 14 and displaced to the position shown in FIG. 2, pressed by the lower edge 21 of the sleeve part. In this standby mode, the nozzles 2 of the sprinkler do not yet spray extinguishing medium.

Figure 2:
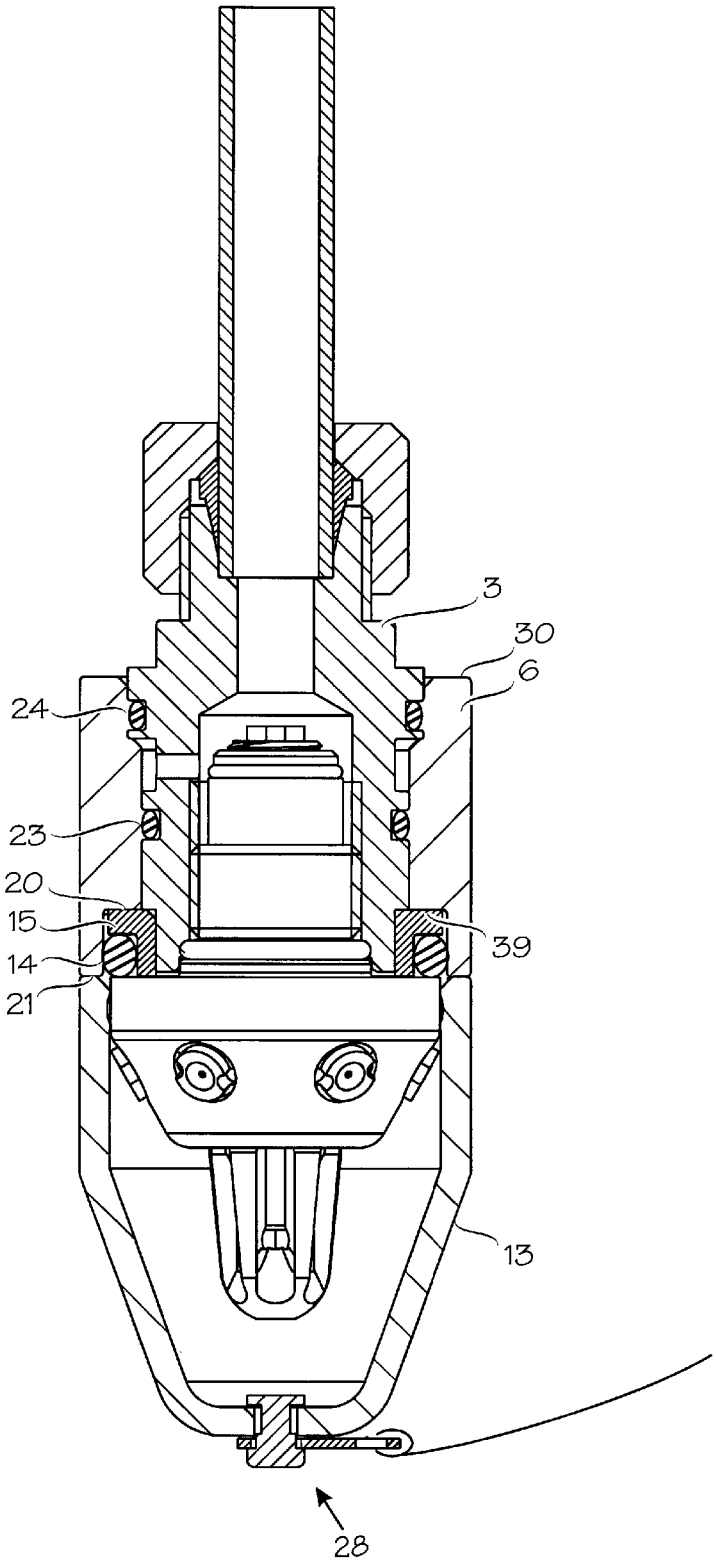
FIG. 2 shows the sprinkler of FIG. 1 in a mode immediately after pre-activation.

From FIGS. 2 and 1 can be seen that the sleeve part 6 comprises a stop 39, which will bear against the flange-like part 15. Therefore, the flange-like part may be called a blocking part 15.

Figure 3:
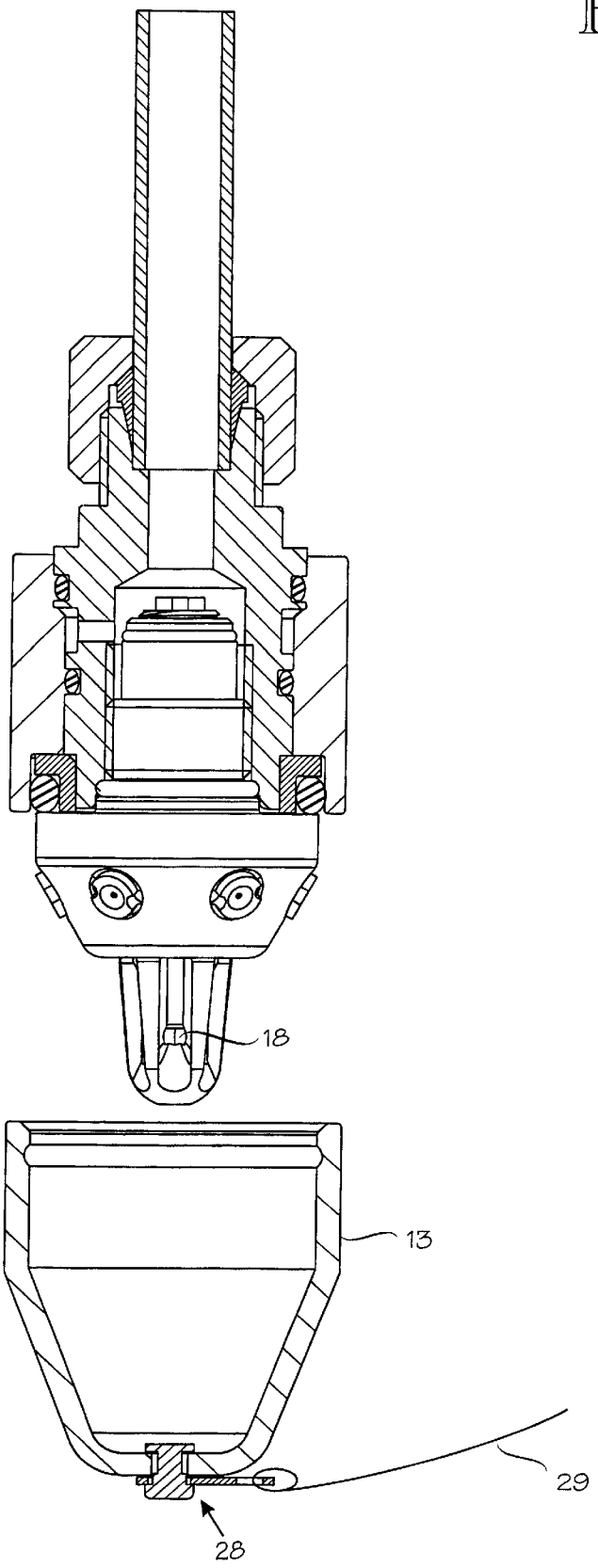
FIG. 3 shows the sprinkler of FIG. 1 and 2 in a standby mode.

When the cover 13 is in the position shown in FIG. 2, it falls off from the sprinkler and is detached from the sleeve part 6 and enters the free position, as shown in FIG. 3. The sprinkler will then be in standby mode.

The sleeve part 6 comprises a third cylindrical inner surface 27 arranged to bear searingly against the ring seal 14 when the sprinkler is displaced to standby mode. As is understood from FIG. 2, the ring seal 14 provides an extra security against leakage if the ring seal 23 is not tight for some reason.

The upper portion 30 of the sleeve part 6 is high enough for the ring seal 24 to bear liquid tight against the holder body 3.

When the sprinkler is in the standby mode shown in FIG. 3, the sprinkler may release in a conventional manner after the glass ampoule 18 has exploded by heat.

Reference numeral 28 signifies a fastening part for receiving the end of a chain or a similar longitudinal element 29, the other end of which is intended to be fastened to the sprinkler or in the vicinity thereof. The element 29 prevents the cup 13 from being lost when the sprinkler passes from inactive mode to standby mode.

In many applications, a heat-activated glass ampoule 18 is to be preferred. Instead of a heat-activated glass ampoule, it is possible to use a heat-activated means of another type: the heat-activated release means may e.g. consist of an eutectic metal or another material melting at low temperature or of a part deforming by heat.

Figure 4:
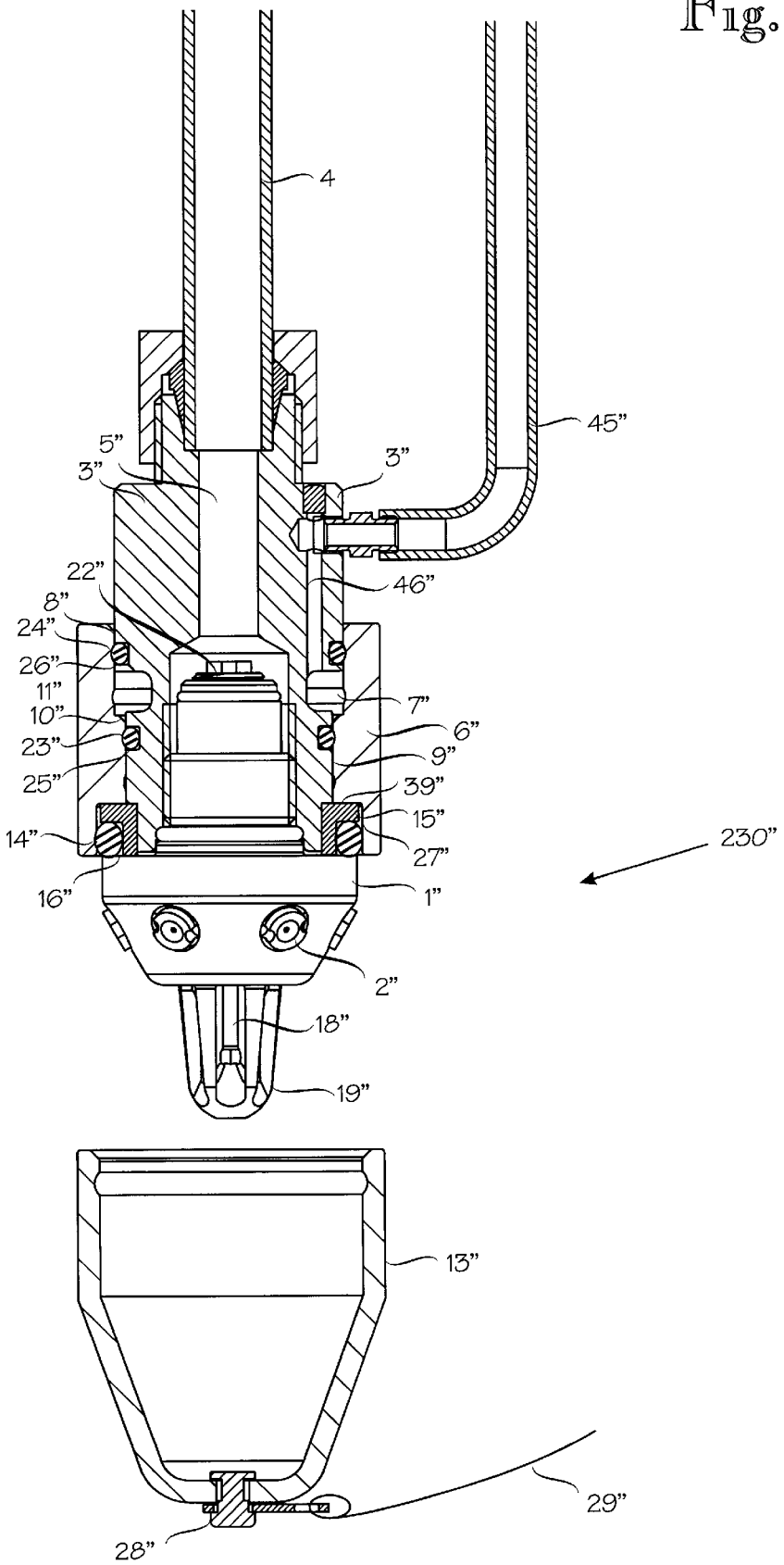
FIG. 4 shows another embodiment of a sprinkler of the invention in a standby mode.

FIG. 4 shows another embodiment of the sprinkler 230" according to the invention in standby mode. In FIG. 4, the same reference numerals are used for the same components as in the FIGS. 1 to 3. The embodiment differs from that of the FIGS. 1 to 3 therein that there is no passage between the pressure chamber 7" and the inlet 5". The sprinkler is activated to the standby mode, where the cover 13" is displaced (see FIG. 3) but the ampoule 18" is unbroken, by means of a separate line 45", which is in fluid communication with the pressure chamber 7" over a passage 46" in the holder body 3". Accordingly, the sprinkler is brought to the standby mode shown in FIG. 4 by means of a fluid pressure or pressure medium in the line 45", which may be called control line, which fluid does not need have any connection with the extinguishing medium in the pipe 4, not even when the sprinkler is in active mode. The fluid may thus be a gas, e.g. air. The fluid may also be equal to the extinguishing medium in the pipe 4, e.g. water. The fluid in the pipe 45" is not in fluid communication with the inlet 5", when the sprinkler is in inactive mode.

An essential advantage of the embodiment of FIG. 4 is that the sprinkler can be brought to standby mode by using small valves (valves 482*a* and 482*b* in FIG. 17; valve 582*a* in FIG. 19; and valves 682*a*,782*a* in FIGS. 22 and 23) and small control pipes (pipes 445, 545, 645 and 745 in FIGS. 17, 19, 22 and 23). This is very important economically, especially if the fire fighting installation will be mounted in a long tunnel (cf. FIGS. 17, 19), which may have a length of about dozens of kilometers. As to the time, the cover 13" can be taken out of the way irrespective of whether the pipe 4 is pressurized or not, i.e. irrespective of whether fluid is fed to the nozzles or not; and additionally, the sprinkler can be made to spray only on condition that both the line 45" and the pipe 4" are pressurized. In the tunnel application, in particular, the pipe 4 (pipes 481 and 581 in FIGS. 17 and 19) is normally pressurized.

Figure 5:
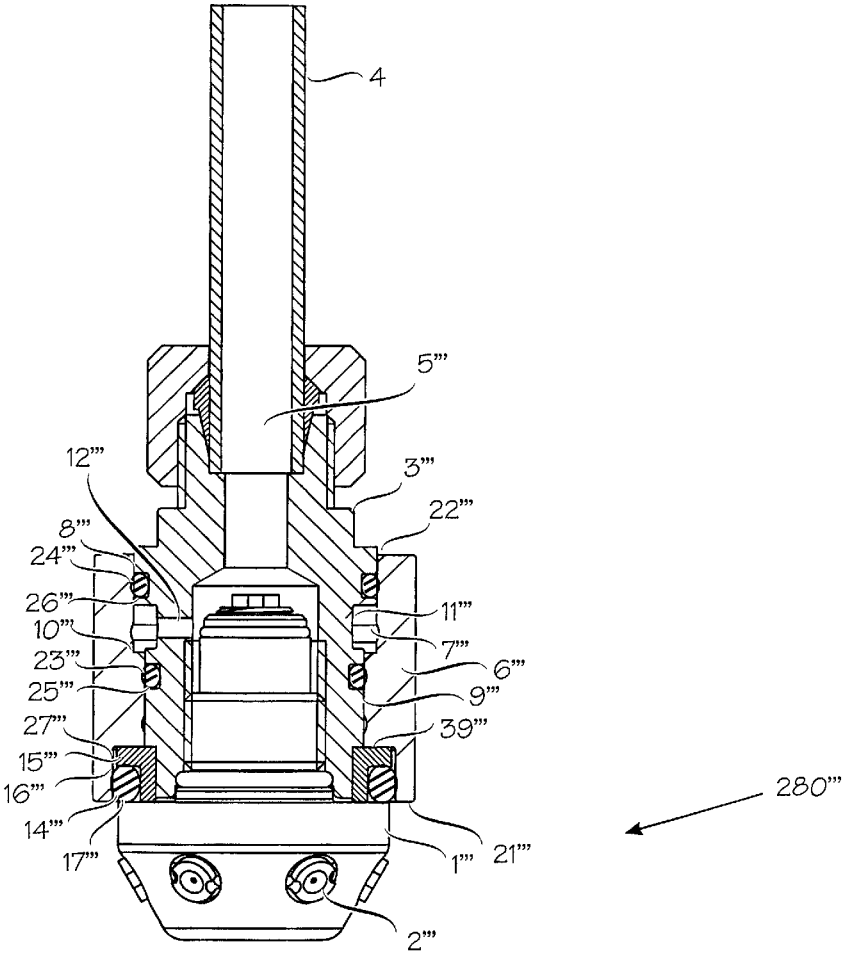
FIG. 5 shows a spray head according to the invention in a mode immediately after activation.
Figure 5:
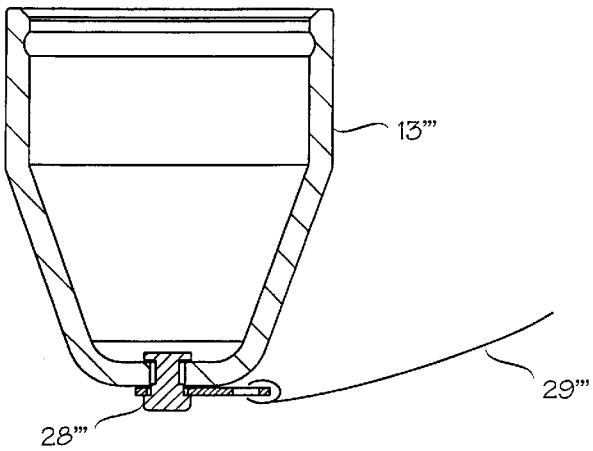

FIG. 5 shows a spray head 280 without any heat-activated release means. Accordingly, a pressure of extinguishing medium acting in the inlet 5" initially causes the sleeve 6" to be displaced downwards, and subsequently, the cover 13"' is pressed down and extinguishing medium can then immediately be sprayed out of the nozzles 2"'. In FIG. 5, reference numerals analogous with those in the FIGS. 1 to 3 are used for similar parts.

The spray head of FIG. 5 can be modified to an extremely simple embodiment by omitting the sleeve 6"' and passage 12"'. A pressure of extinguishing medium acting in the inlet 5"' implies here that extinguishing medium flows directly into the nozzles 2"' and out of them. After the space remaining within the cover 13"' and the nozzle body 1"' has been filled with extinguishing medium, the extinguishing medium exerts a force against the cover 13"' and the locking device constituted by the ring seal 14"' and the groove 17"', resulting in that the locking device opens and the cover is pressed down and out of the way of the nozzles 2"', and after this, the spray head can spray normally with the nozzles.

Figure 6:
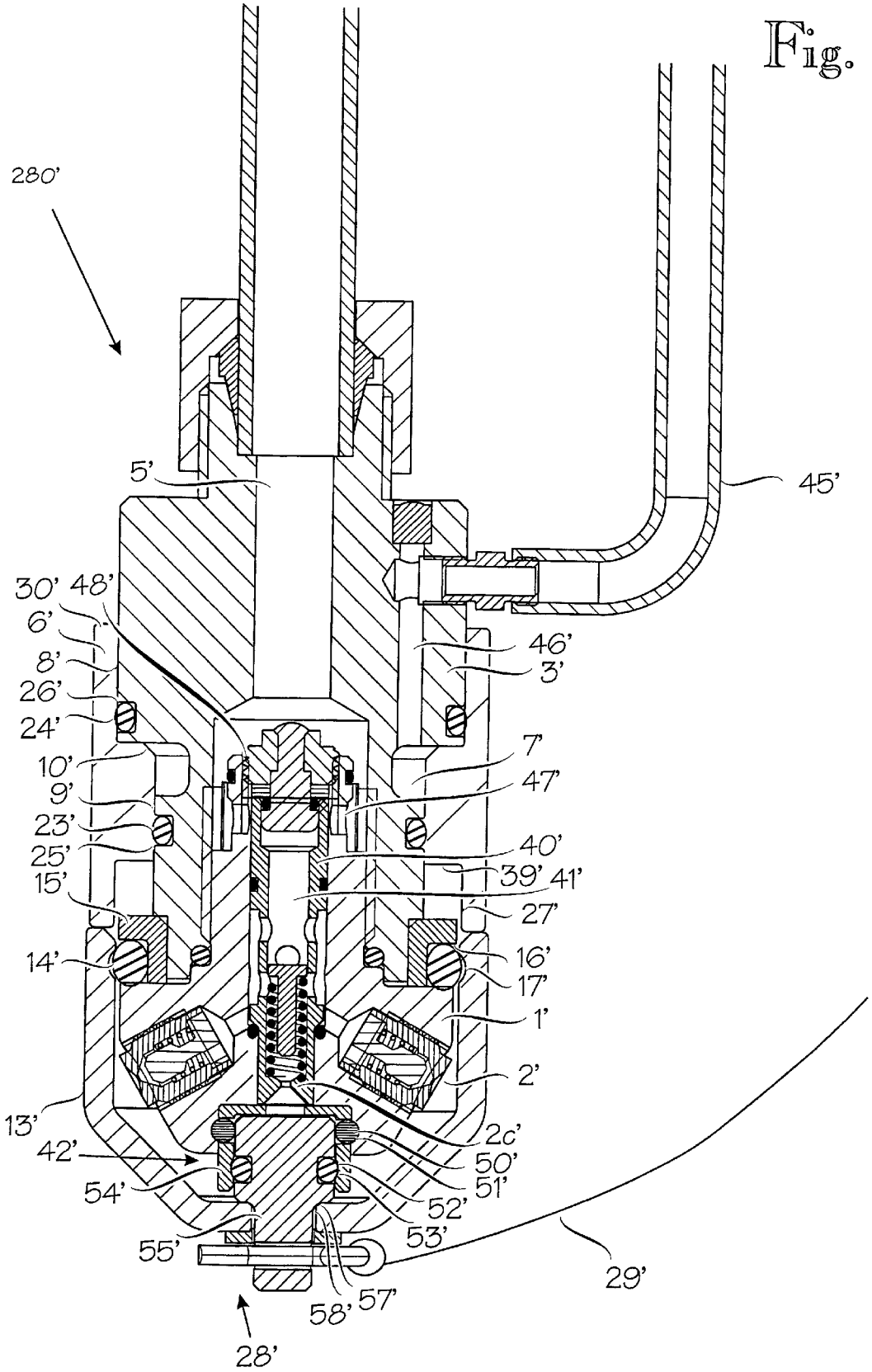
FIG. 6 shows a further spray head according to the invention in a first inactive mode.
Figure 7:
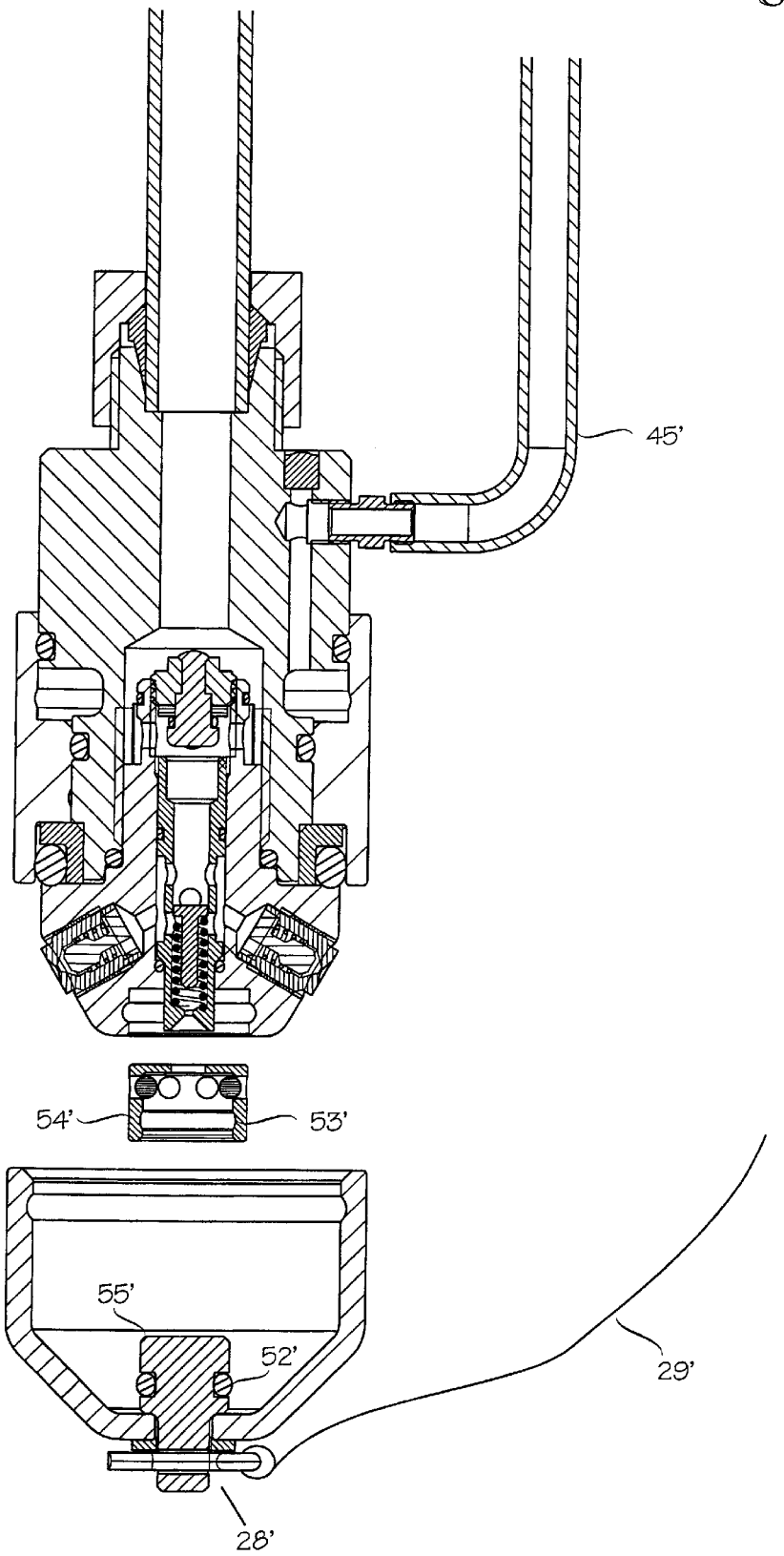
FIG. 7 shows the spray head of FIG. 6 in a mode immediately after activation.

FIGS. 6 and 7 show a further spray head 280' according to the invention in a first inactive mode and in an active mode, respectively. The figures use reference numerals corresponding to those used in FIG. 4 for similar components. The nozzle body 1'with components belonging to it, such as a displaceable spindle 40' loaded by a spring 48' and provided with a channel 41' for leading extinguishing medium from the inlet 47' of the nozzle body to the nozzles 2', 2*c*', can preferably be of such a pressure-compensated (pressure-balanced) type which is disclosed in the publication WO 96/08291. The spray head does not need to be pressure-compensated. A possible high pressure acting in the inlet of the channel leading to the nozzles 2' does not reach the nozzles until the spindle 40' has been displaced. When the spindle 40' is displaced, with a closing part 42' being opened, a fluid communication between the inlet of the nozzle body and the nozzles 2' opens, so that these may spray extinguishing medium. Initially, the spray head can be made to spray only on condition that both the line 45' and the pipe 4 are pressurized. If there is no fluid in the pipe 4, said pre-activation is in question, which only implies that the cover 13' is displaced aside. The spray head 280' of FIG. 6 can preferably be applied to the fire fighting installations of the FIGS. 13, 14, 19, 22 and 23.

As mentioned earlier, the spray head needs not be pressure-balanced: especially in a dry pipe system, for instance, where no pressure of extinguishing medium acts in the inlet initially. In a wet pipe system as well, it is possible to use a non-pressure-balanced spray head on account of the closing part 42' preventing the spindles 40 from being pressed downwards by the spring 48', when the spray head is in passive mode with the cover 13' closed. When the pressure chamber 7' is pressurized, the cover 13' and also the closing part 42', being fastened to the cover, are pressed downwards, which results in that the spindle 40' is pressed downwards by the force of the spring 48' and the pressure of extinguishing medium directed to the spindle so that the spindle is out of the way of the inlet 7' and extinguishing medium can flow from the inlet 5' over the channel 41' to the nozzles 2', 2*c*'. When the spray head is in the inactive mode shown in FIG. 6, the closing part 42' is kept in place in the nozzle body 1' by locking means comprising a first locking part 54' and a second locking part 55'. The first locking part 54' is locked to the nozzle body 1' by means of displaceable elements 50', e.g. metal spheres. The second locking part 55' is fastened to the first locking part 54' by an O-ring 52' positioned in a cylindrical groove 53' in the second locking part 55' when the spray head is in the inactive mode. The O-ring 52' keeps the second locking part 55' in place in the first locking part 54', though the cover 13' has not been mounted yet. Thanks to this, the final mounting of the spray head is simple: only the cover 13' needs to be mounted at the place where the spray head shall be placed, because the O-ring 52' and the locking parts 54', 55' can be (ready) mounted at the factory. The second locking part 55' is also fastened to an opening 58' in the cover 13'. A cotter 28' or any locking element, in principle, can transmit the force from the cover 13' to the second locking part 55' so that this comes along when the cover is displaced. The second locking part 55' has such a shape that a support 57' is formed against the opening 58' of the cover.

The elements 50' are arranged to be displaced to a position enabling detachment of the first locking part 54' from the nozzle body 1' when the second locking part 55' is displaced in relation to the first locking part. This takes place when the cover 13' is pressed downwards by a pressure from the control line 4'. In connection with this, the spindle 40' presses the first locking part 55' out of the nozzle body so that the spray head comes to the active mode shown in FIG. 7.

Figure 8:
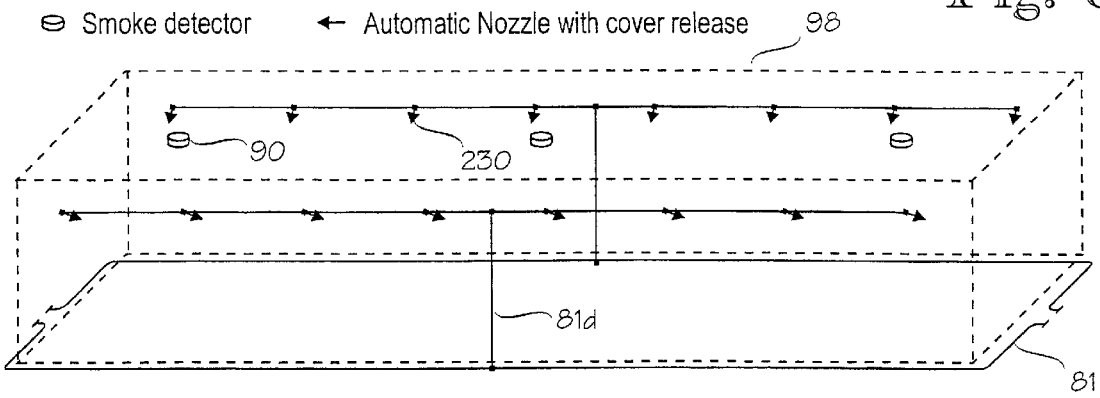
FIG. 8 shows a first embodiment of the installation of the invention.
Figure 9:
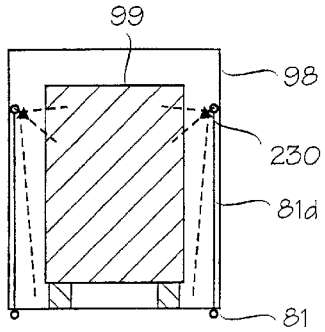
FIGS. 9 to 12 show another embodiment of the installation of the invention.

FIGS. 8 and 9 illustrate an open railway wagon 98 for transporting goods, such as vehicles 99. Sprinklers 230 of the type shown in FIG. 1 are mounted in the railway wagon. The sprinklers 230 are coupled to a source of extinguishing medium (not shown) over a pipe system 81, which supplies them, in case of fire, with extinguishing medium, preferably water-based extinguishing medium. The pipe system 81 extends along all wagons of the train, only one of them being shown in FIG. 8. The reference numeral 81*d* refers to a distribution line.

Reference numeral 90 refers to a fire detector. The detector 90 is e.g. of a type responding to radiation. It can preferably be an IR detector, but it may alternatively be a detector responding to UV radiation. An optical cable detector, a smoke detector or a gas detector is also possible. At detection of a fire, e.g. detection of a surface heated by the fire, the detector 90 gives a signal to a pump (not shown) to start delivering extinguishing medium into the conduit 81. Consequently, the covers of all sprinklers 230 fall off and the sprinklers enter a standby mode, where they can respond to hot smoke gases.

A manual activation of the installation can compensate for said detector activating system.

Figure 10:
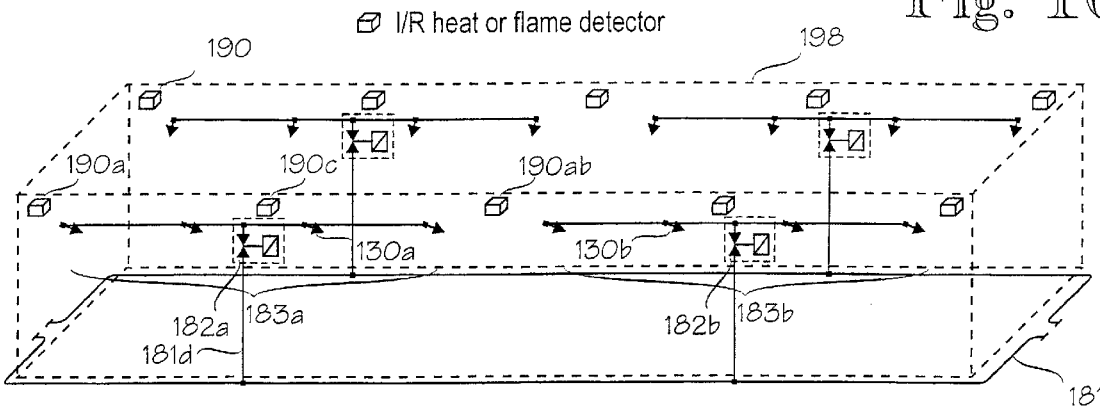
Figure 11:
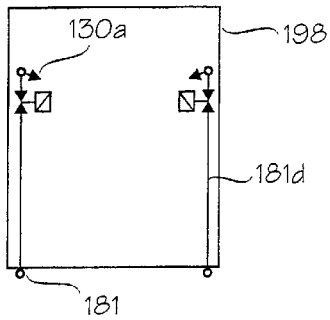

FIG. 10 shows another embodiment of the installation according to the invention. The figure uses reference numerals corresponding to those used in FIG. 8 for similar components. The installation of FIG. 10 differs from that of FIG. 8 by the railway wagon 198 being divided into sections 183*a*, 183*b* by means of section valves 182*a*, 182*b*.

If a detector 190*a* responds to a fire, it gives a signal to the section valve 182*a* to open. The sprinklers 130*a* then enter the standby mode with their ampoules uncovered. If hot smoke gases then flow towards a sprinkler 130*a*, the ampoule explodes and the sprinkler releases. The detector 190*ab* is arranged to give a signal both to the section valves 182*a* and 182*b*, i.e. both to section 183*a* and 183*b*.

Instead of dividing the railway wagon into four sections, as shown in the figure, it is possible to divide the railway wagon 198 alternatively e.g. into two sections in such a way that the sections 183*a* and 184*b* constitute one section only, in which case one section valve, e.g. 182*a*, is enough.

Figure 12:
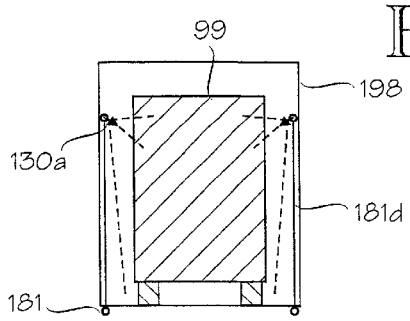

FIG. 12 shows a lorry 199 in the railway wagon 198 and how the sprinklers 130*a* are arranged to spray towards the lorry.

Figure 13:
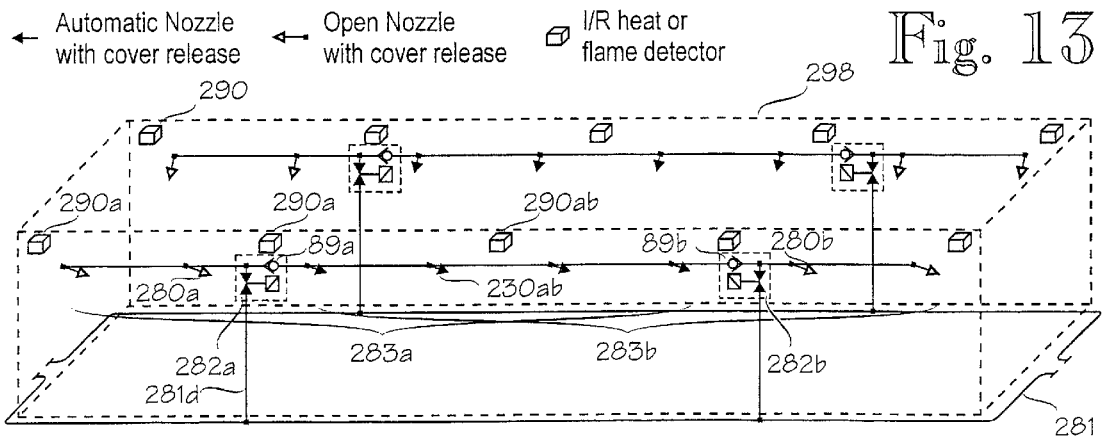
FIG. 13 shows a third embodiment of the installation of the invention.

FIG. 13 shows an installation similar to the installation of FIG. 10, but with the essential difference that it comprises, not only sprinklers 230*ab*, but also spray heads 280*a*, 280*b* without release means, e.g. spray heads of the type described in FIG. 5. The sprinklers 230*ab* and the spray heads 280*a*, 280*b*, and more exactly the nozzles in them, can preferably be also of the type disclosed in WO98/58705, the content of which is incorporated in this text. The last-mentioned spray heads have nozzles with a variable k factor so that the flow increases strongly with increasing pressure of the extinguishing medium. FIG. 10 uses reference numerals corresponding to those of FIG. 8 for similar parts.

Another difference compared with FIG. 10 is that the installation comprises non-return valves 89*a*, 89*b* preventing the section valve 282*a* from giving extinguishing medium to the spray heads 280*b* in the section 283*b*. The non-return valves 89*a* and 89*b* are built in corresponding valves 282*a*, 282*b*, but could alternatively be coupled directly to the conduit distributing extinguishing medium to the spray heads/sprinklers with the same result, as far as the function of the installation is concerned.

The installation of FIG. 13 functions in such a way that e.g. the detector 290*a* gives a signal, whereby the section valve 282*a* opens and the spray heads 280*a* start spraying extinguishing medium immediately. The sprinklers 230*ab* do not start spraying until their ampoules have exploded by heat. If the detector 290*ab* opens, it gives a signal to open both the section valve 282*a* and 282*b*. Extinguishing medium flows then both to section 283*a* and to section 283*b*. The spray heads 280*a* and 280*b* start spraying extinguishing medium immediately, but the sprinklers 230*ab* do not start spraying until their ampoules have exploded by heat.

Figure 14:
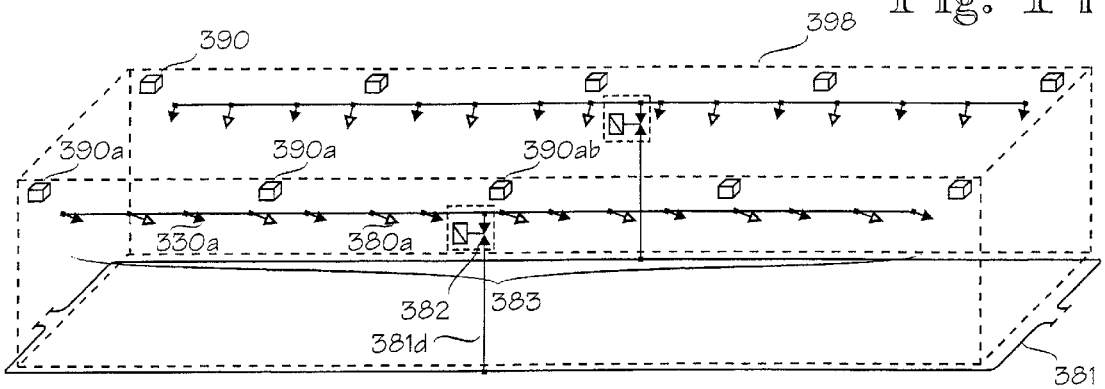
FIG. 14 shows a fourth embodiment of the installation of the invention.

FIG. 14 shows a further installation according to the invention. The figure uses reference numerals corresponding to those in the previous figures for similar components.

The installation of FIG. 14 comprises two sections 383 extending along both sides of the railway wagon 398 and comprising both sprinklers 330*a* and spray heads 380*a*. When the fire detector 390*a* gives a signal to the section valve 382, extinguishing medium flows to the sprinklers 330*a* and the spray heads 380*a*. The spray heads 380*a* start spraying immediately, but the sprinklers do not, until their ampoules have exploded by heat. Accordingly, it is possible to deliver most extinguishing medium at certain points having the highest temperature along the railway wagon 398, at the same time as the spray heads 380*a* (not having an ampoule or another heat-activated release means) attend to initial cooling in the section where the fire has been detected. The spray heads 380*a* in the section 383 have also the function to prevent spray heads and sprinklers in the section located on the opposite side of the railway wagon 398 from functioning prematurely, which results in that extinguishing medium is not delivered unnecessarily.

Figure 16:
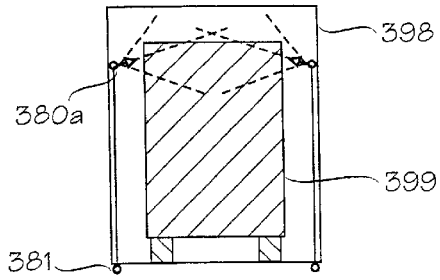

The embodiment of FIG. 14 differs from previous embodiments also in such a way that part of the spray heads 380*a* are directed upwards, see FIG. 16. Thanks to the fact that the spray heads 380*a* deliver extinguishing medium to the upper portion of the railway wagon, an effective cooling is achieved in areas where the temperature otherwise would be high and could cause ignition of smoke gases and a fast spreading of the fire. It is, of course, also possible to make spray heads/sprinklers spray upwards in the embodiments of FIGS. 8,10 and 13.

Figure 15:
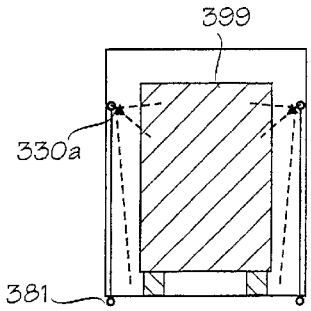
FIGS. 15 and 16 illustrate a discharge of extinguishing medium towards an object in the installation of FIG. 14, FIGS. 17 and 18 show a fifth embodiment of the installation of the invention.

FIGS. 15 and 16 show how the spraying angles of the sprinklers 330*a* and the spray heads 380*a* preferably can be.

Figure 17:
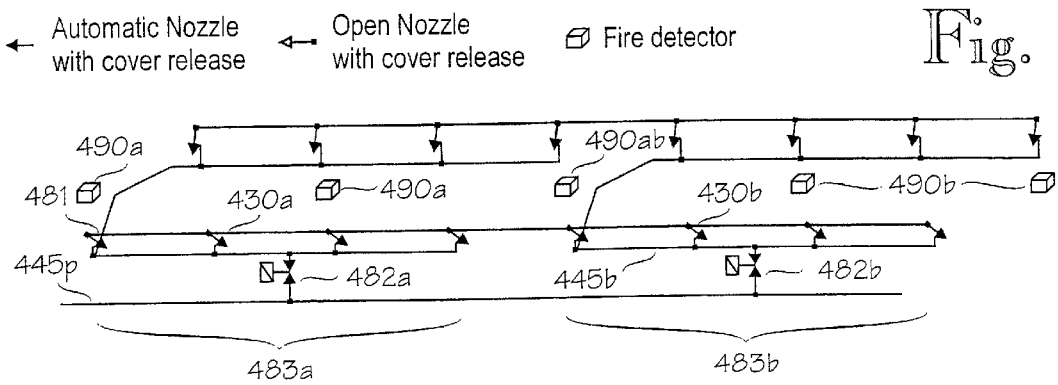
Figure 18:
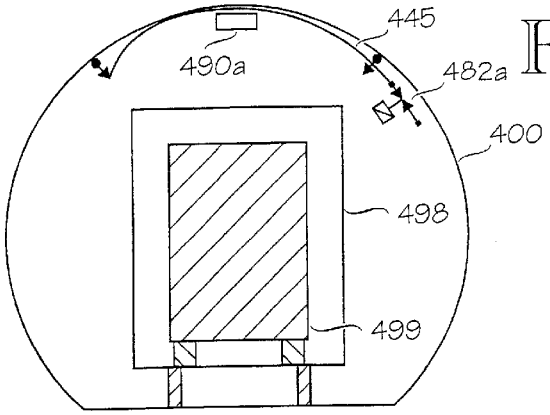

FIGS. 17 and 18 show an installation mounted in a railway tunnel 400. A pipe system 481 extends along the tunnel 400. The sprinklers 430*a*, 430*b* of the installation are of the type shown in FIG. 4. The sprinklers 430*a*, 430*b* are mounted directly to the pipe system 481. By means of a pneumatic line 445*p*, the spray heads 430*a*, 430*b* are brought to standby mode over a section valve 482*a*, 482*b*, after a fire detector 490*a*, 490*ab* or 490*b* has given a signal. The fire detector 490*a* controls the section 483*a*; the fire detector 490*ab* controls the sections 483*a* and 483*b*; and the fire detector 490*b* controls the section 483*b*. The pressure in the line 445*p* can be much lower (more than 10 times lower), e.g. 6 bar, than the pressure in the line 481 (and the lines 81, 181, 281 and 381 in previous figures). The section valves 482*a*, 482*b* can have small dimensions (e.g. NS 1,5) and be inexpensive compared with the section valves (of the type NS 20, for instance) in FIGS. 10, 13 and 14. The dimension of the line 445*p* (and the lines 445*a*, 445*b*) can be small, e.g. 6 mm, compared with the line 481 (and 81, 181, 281 and 381), e.g. 50 mm and the lines (distribution lines) 81*d*, 181*d*, 281*d* and 381*d*, e.g. 25 mm, in the FIGS. 8 to 13. This means substantial savings in the costs for long tunnels and similar applications, where the installation is very long, compared with the use of sprinklers of the type not comprising a separate line for the activation of the sprinklers, because no rough distribution lines, the length of which shall correspond to the length of the tunnel, are needed between the section valves and the sprinklers.

In FIG. 17, part of the sprinklers can be changed for spray heads without heat-activated release means, e.g. of the type shown in FIG. 6.

Inside the railway wagon 498, there can be an installation of the type illustrated in the FIGS. 8,10, 13 and 14.

Figure 19:
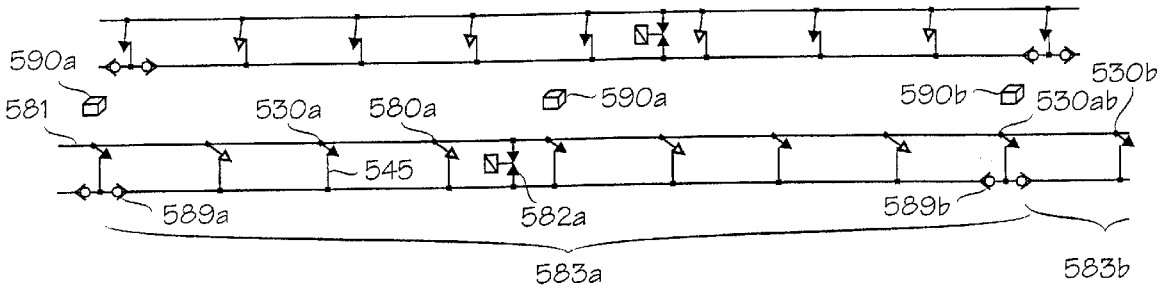
FIGS. 19 to 21 show a sixth embodiment of the installation of the invention.
Figure 20:
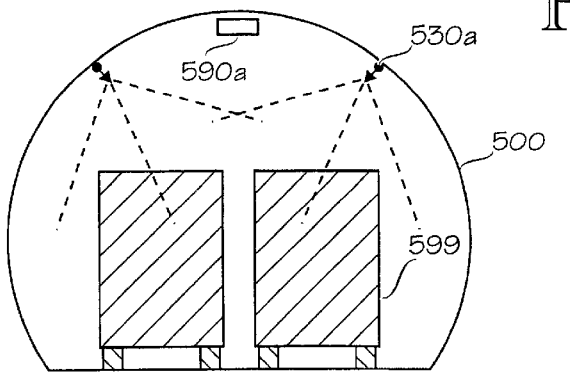
Figure 21:
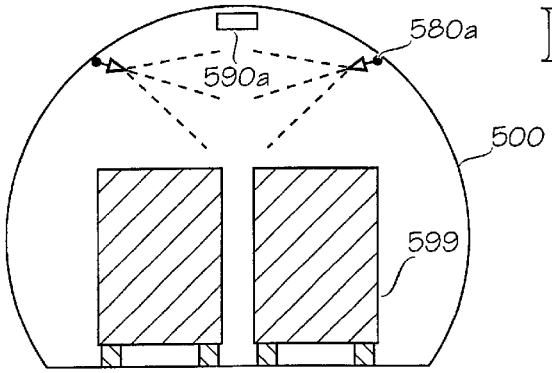

FIGS. 19 to 21 show an installation for a car tunnel 500. The figures use reference numerals corresponding to those used in the FIGS. 17 and 18 for similar things. The sprinklers 530*a*, 530*b* are of the type shown in FIG. 4 and the spray heads of the type shown in FIG. 6.

The installation of FIGS. 19 to 21 differs from that of FIGS. 17 and 18 by the section valves 582*a*, 582*b* being arranged to feed extinguishing medium from the conduit 581 into the control pipes 545 (the pipes 45' and 45" in FIGS. 6 and 4) of the sprinklers 530*a*, 530*b*, 530*ab* and the spray heads 580*a*. In addition, non-return valves 589*a*, 589*b* have been arranged in the control pipe 545 for preventing fluid from flowing from one section to another (e.g. from section 583*a* to section 583*b* and vice versa). Non-return valves can naturally also be placed in connection with the control lines 445*a*, 445*b* in FIG. 17 in case if the control lines were combined to a long control line. The sprinkler 530*ab* is common for the sections 583*a* and 583*b*.

As shown in FIG. 20, the sprinklers 530*a*, 530*b* are directed towards the central parts of the tunnel 500 and towards the lorries 599, while at least part of the spray heads 580*a* are arranged to deliver extinguishing medium towards the upper portion of the tunnel 500 for preventing smoke gases from ignition. The water amount in the spray heads 580*a* spraying at ceiling (roof level can be considerably smaller than in the sprinklers 530*a* and the spray heads shall have a small droplet size (typically smaller than the sprinklers 530*a* have) to provide an effective cooling. Part of the spray heads 580*a*, 580*b* may, of course, be directed towards the central parts of the tunnel.

Figure 22:
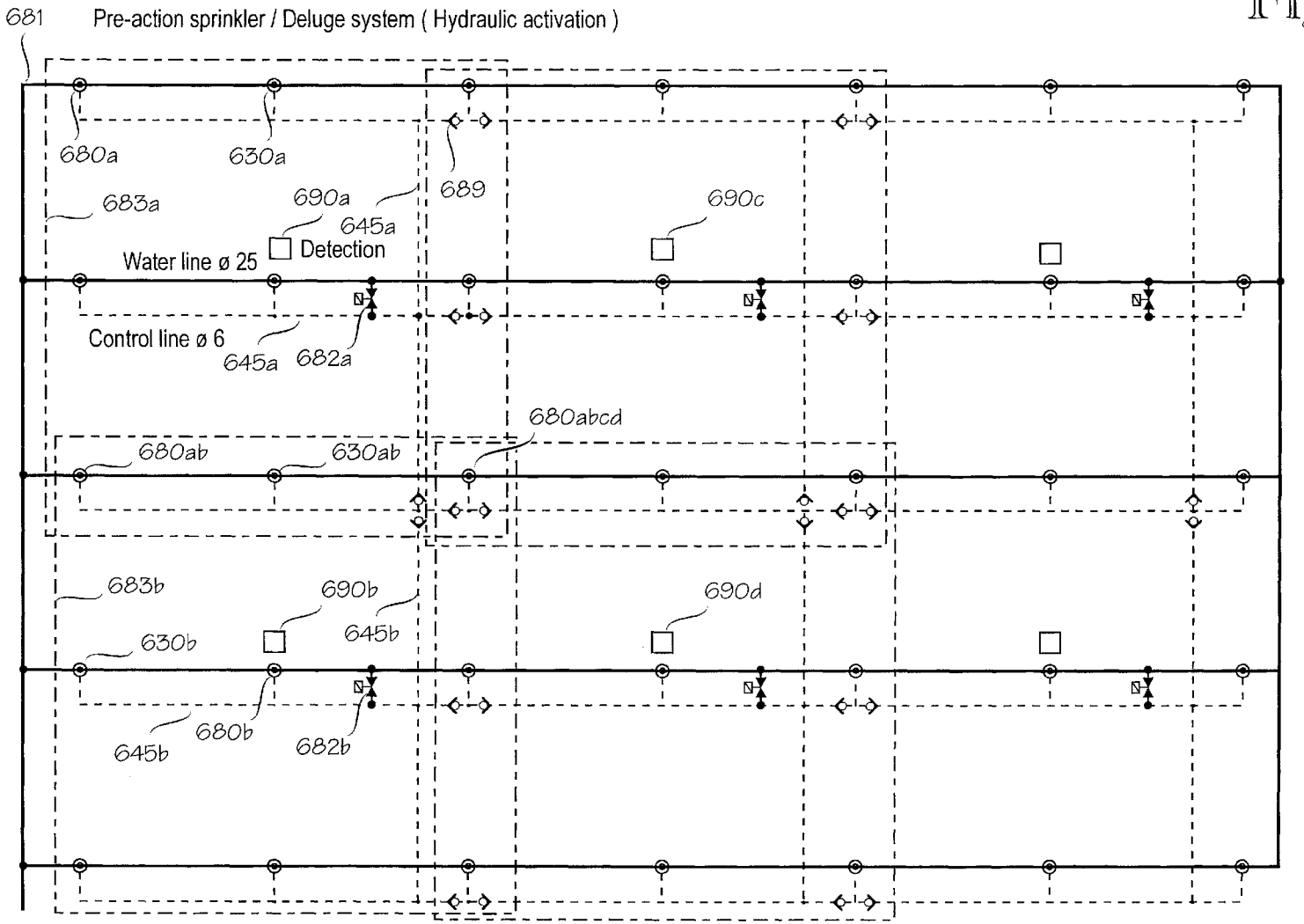
FIG. 22 shows a seventh embodiment of the installation of the invention.

FIG. 22 shows a general design for the installation according to the invention. The figure uses reference numerals corresponding to those used in the previous figures for similar components. The installation of FIG. 22 can be used for instance in factory installations, high storage and car decks on ferries. The section valves 682*a*, 682*b* are coupled to the control lines 645*a*, 645*b* and the pipe line 681 in such a way that the sprinklers 630*a* and the spray heads 680*a* are activated by the pressure of the extinguishing medium over the section valve 682*a* and the control line 645*a*, and the sprinklers 630*b* and the spray heads 680*b* are activated by the pressure of the extinguishing medium over the section valve 682*b* and the control line 645*b*. The fire detector 690*a* controls the section valve 682*a* and the section 683*a*, and the fire detector 690*b* controls the section valve 682*b* and the section 683*b*. The spray head 680*abcd* becomes active when whichever of the fire detectors 690*a*, 690*b*, 690*c* or 690*d* gives a signal.

The sprinklers 630*a*, 630*b* are preferably of the type shown in FIG. 4 and the spray heads 680*a*, 680*b*, 680*abcd* are preferably of the type shown in FIG. 7.

Part of the sprinklers of FIG. 22 or all of them can be changed for spray heads without heat-activated release means and vice versa.

Figure 23:
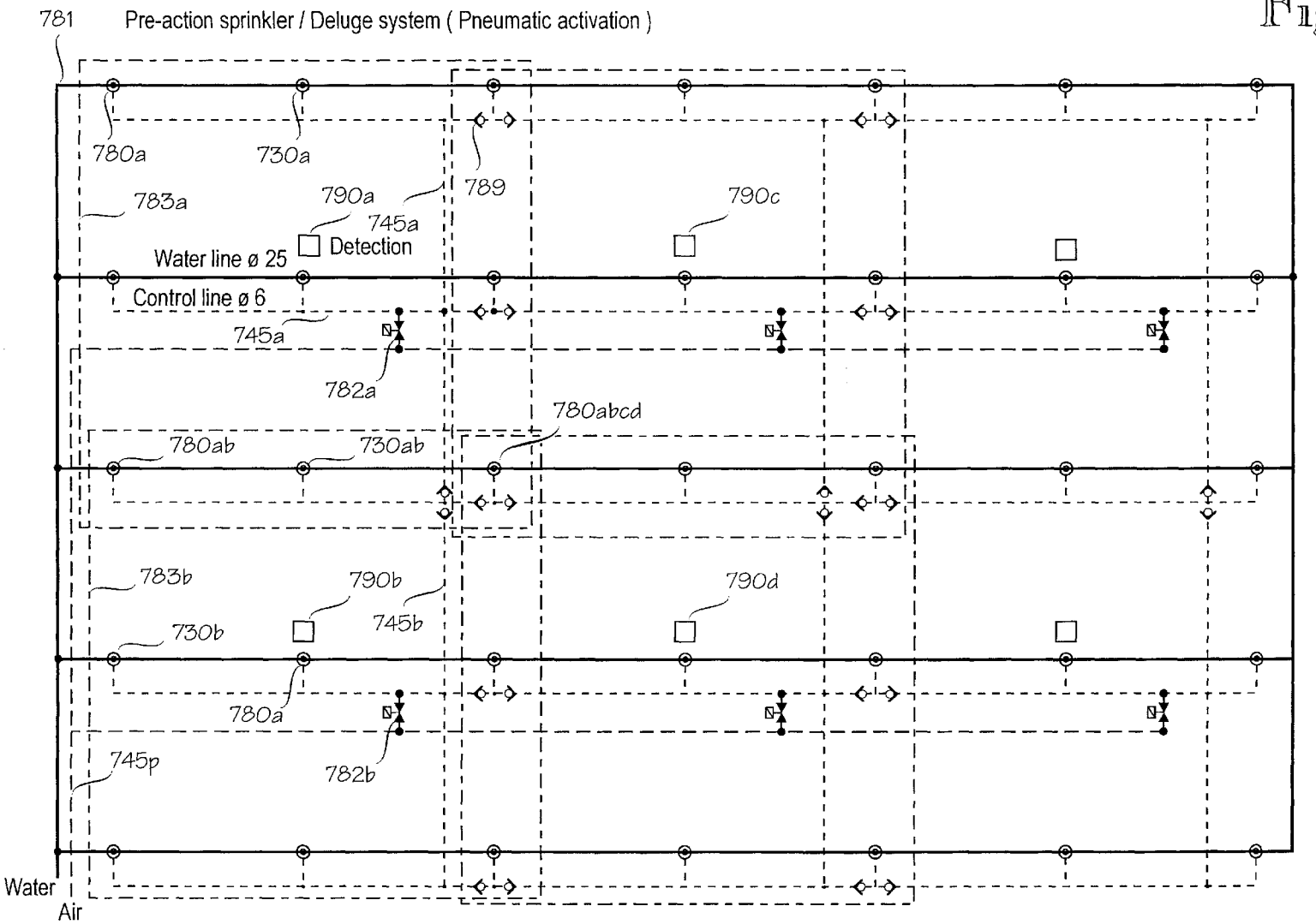
FIG. 23 shows an eighth embodiment of the installation of the invention.

FIG. 23 shows another embodiment for the general design of the installation according to the invention. The figure uses reference numerals corresponding to those used in the previous figures for similar components. The installation of FIG. 23—like the installation of FIG. 22—can be used e.g. in factory installations, high storage spaces and car decks on ferries. The installation of FIG. 23 differs from that of FIG. 22 by the section valves 782*a*, 782*b* being coupled to pneumatic control pipes 745*a*, 745*b* and 745*p*, which do not have any connection with the extinguishing medium pipe 781.

All installations of the FIGS. 8 to 20 comprise preferably a source of extinguishing medium (not shown), water-based fluid constituting the extinguishing medium. At least part of the spray heads used for the installation may preferably be of the type described in WO92/20453, i.e. they give off a concentrated penetrating mist of water, which is capable of penetrating into the seat of fire.

The invention has been described above with reference to one example only. Therefore, it is pointed out that the details of the invention may differ from the examples in many respects within the scope of the attached claims. Accordingly, e.g. the division into sections may vary according to the application. As appeared earlier, the application of the FIGS. 8 to 16 needs not necessarily be a means of transportation in the form of a railway wagon, but it can be some other means of transportation, for instance a ferry. Further, the installation can be used for other spaces, both open and closed, which do not necessarily have anything to do with means of transportation.

What is claimed is:

1. Installation for extinguishing fire, the installation comprising a number of spray heads (130*a*, 130*b*; 230; 230*ab*, 280*a*, 280*b*; 330*a*, 380*a*; 430*a*, 430*b*; 530*a*, 530*b*, 530*ab*, 580*a*, 580*b*; 630*a*, 630*b*, 630*ab*, 680*a*, 680*b*, 680*ab*, 680*abcd*; 730*a*, 730*b*, 780*a*, 780*b*, 780*ab*, 780*abcd*), a pipe system (81; 181; 281; 381; 481; 581; 681; 781) for leading extinguishing medium to the spray heads, the spray heads comprising a holder body (3, 3', 3", 3"') having an inlet (5, 5', 5", 5"') for incoming extinguishing medium and at least one nozzle (2, 2', 2", 2"'), wherein the spray heads (130*a*, 130*b*; 230; 230*ab*, 280*a*, 280*b*; 330*a*, 380*a*; 430*a*, 430*b*; 530*a*, 530*b*, 530*ab*, 580*a*, 580*b*; 630*a*, 630*b*, 630*ab*, 680*a*, 680*b*, 680*ab*, 680*abcd*; 730*a*, 730*b*, 780*a*, 780*b*, 780*ab*, 780*abcd*) comprise a cover (13, 13', 13", 13"'), positioned by means of a locking device (14, 17, 14', 17', 14", 17", 14"', 17"') in a protective position in front of said nozzle (2, 2', 2", 2"') when the installation is in an inactive mode and, upon activation of the installation, arranged to be displaced to a free position by opening the locking device, in which free position the cover is out of the way of said nozzle so that the nozzle may spray extinguishing medium when the spray head is in an active mode, the cover being arranged to be displaced to the free position by a pressure medium exerting a force on the locking device so that it opens (FIGS. 8, 10, 13, 14, 17, 19, 22, 23).

2. Installation according to claim 1, wherein the spray heads (130*a*, 130*b*; 230; 230*ab*, 280*a*, 280*b*; 330*a*, 380*a*; 430*a*, 430*b*; 530*a*, 530*b*, 530*ab*, 580*a*, 580*b*; 630*a*, 630*b*, 630*ab*, 680*a*, 680*b*, 680*ab*, 680*abcd*; 730*a*, 730*b*, 780*a*, 780*b*, 780*ab*, 780*abcd*) comprise a displaceable device (6, 6', 6", 6''') arranged to be displaced in relation to the holder body (3, 3', 3", 3''') for displacing the cover (13, 13', 13", 13''') to the free position (FIGS. 8, 10, 13, 14, 17, 19, 22, 23).

3. Installation according to claim 2, wherein the displaceable device (6, 6', 6", 6''') comprises a projection area being exposed to pressure of said pressure medium for exerting the force against the locking device (14, 17, 14', 17', 14", 17", 14''', 17''') by means of the fluid pressure in a pressure chamber (7, 7', 7", 7''').

4. Installation according to claim 3, wherein the displaceable device is a sleeve-like part (6, 6', 6", 6'''), which together with the holder body (3, 3', 3", 3''') defines the pressure chamber (7, 7', 7", 7''').

5. Installation according to claim 1, wherein an optical detector or a detector responding to radiation heat or smoke (90; 190; 290; 390; 490*a*; 590*a*; 690*a*; 790*a*, 790*b*, 790*c*, 790*d*) is provided, said detector being arranged to start feeding extinguishing medium to the spray heads (80; 180; 130*a*, 130*b*; 230; 230*ab*, 280*a*, 280*b*; 330*a*, 380*a*; 430*a*; 530*a*, 530*b*, 530*ab*, 580*a*, 580*b*; 630*a*, 630*b*, 630*ab*; 680*a*, 680*b*, 680*ab*, 680*abcd*; 730*a*, 730*b*, 780*a*, 780*b*, 780*ab*, 780*abcd*) and to provide said force.

6. Installation according to claim 3, wherein the pressure chamber (7', 7") is in fluid communication with a control line (445*a*, 445*b*; 545; 645*a*, 645*b*; 745*a*, 745*b*) over a passage (46', 46") in such a way that a pressure of a pressure medium in the control line is arranged to provide said force against the locking device (14', 17', 14", 17") (FIG. 17, 19, 22, 23).

7. Installation according to claim 6, wherein the control line (445*a*, 445*b*; 745*a*, 745*b*) is not in fluid communication with the inlet (5', 5") when the spray head (430*a*, 430*b*, 730*a*, 780*a*, 780*b*, 780*ab*, 780*abcd*) is in the inactive mode.

8. Installation according to claim 1, wherein the spray heads (130*a*, 130*b*; 280*a*, 280*b*; 330*a*, 380*a*; 430*a*, 430*b*; 530*a*, 530*b*, 530*ab*, 580*a*, 580*b*; 630*a*, 630*b*, 630*ab*, 680*a*, 680*b*, 680*ab*, 680*abcd*; 730*a*, 730*b*, 780*a*, 780*b*, 780*ab*, 780*abcd*) are arranged in a number of sections (183*a*, 183*b*; 283*a*, 283*b*; 383; 483*a*, 483*b*; 583*a*, 583*b*; 683*a*, 683*b*; 783*a*, 783*b*) to be activated separately or in groups, each section comprising a number of spray heads (FIG. 10, 13, 14, 17, 19, 22, 23).

9. Installation according to claim 8, wherein a non-return valve (89*a*, 89*b*; 589*a*, 589*b*; 689; 789) is provided for leading extinguishing medium to one section (283*a*, 283*b*; 583*a*, 583*b*; 683*a*, 683*b*; 783*a*, 783*b*) of the number of sections and for preventing extinguishing medium from flowing to at least part of the spray heads in an adjacent section (FIG. 13, 21, 22, 23).

10. Installation according to claim 1, wherein part of said spray heads are sprinklers (230*ab*; 330*a*; 530*a*, 530*b*, 530*ab*; 630*a*, 630*b*, 630*ab*; 730*a*, 730*b*, 730*ab*) comprising a heat-activated release means (18, 18") and part of the spray heads (280*a*, 280*b*; 380*a*, 380*b*; 580*a*, 580*b*; 680*a*, 680*b*, 680*abcd*; 780*a*, 780*b*, 780*ab*; 780*abcd*) are without any heat-activated release means, which sprinklers, when the cover (13, 13") is displaced to the free position, are arranged to enter a standby mode, where the heat-activated release means is intact in order to be able to respond to heat and to provide in this way a release of the corresponding sprinkler and to bring it to an active mode, in which it sprays extinguishing medium (FIG. 12, 14, 19, 22, 23).

11. Installation according to claim 10, wherein a section (282*a*, 282*b*; 383; 583*a*; 683*a*, 683*b*; 783*a*, 783*b*) is provided, said section comprising both spray heads (280*a*; 380*a*; 480*a*; 680*a*; 780*a*) without heat-activated release means and sprinklers (230*ab*; 330*a*; 430*a*) (FIG. 13, 14, 22, 23).

12. Installation according to claim 6, wherein the control lines (445*a*, 445*b*; 545; 645*a*, 645*b*; 745*a*, 745*b*) of the spray heads (430*a*; 530*a*, 580*a*; 630*a*, 680*a*; 730*a*, 780*a*) belonging to a group are coupled to a control valve (482*a*; 582*a*; 682*a*; 782*a*) arranged to let fluid flow to the spray heads at detection of a fire (FIG. 17, 19, 22, 23).

13. Installation according to claim 12, wherein non-return valves (589*a*; 689; 789) are connected to the control lines (545; 645*a*, 645*b*; 745) for detaching the covers of certain spray heads and for preventing the covers of the remaining spray heads from being detached (FIG. 19, 22, 23).

14. Installation according to claim 12, wherein the control valve (482*a*; 782*a*) is coupled to a pneumatic line (445*p*; 745*p*) for leading air to the spray head (430*a*; 730*a*, 780*a*) at detection (FIG. 17, 23).

15. Installation according to claim 14, wherein the control valve (582*a*; 682*a*) is coupled to the pipe system (581; 681) for leading extinguishing medium to the spray head (530*a*, 580*a*; 630*a*, 680*a*) at activation (FIG. 19, 22).

16. Combination of a means of transport and an installation for extinguishing fire, wherein a number of spray heads (230, 230*ab*; 280*a*, 280*b*; 330*a*, 380*a*) and a pipe system (81; 181; 281; 381) for leading extinguishing medium to the spray heads are provided, the spray heads comprising a holder body (3, 3', 3'''), at least one nozzle (2, 2', 2'''), a cover (13, 13', 13'''), positioned by means of a locking device (14, 17, 14', 17', 14", 17", 14''', 17''') in a protective position in front of said nozzle (2, 2', 2''') when the installation is in an inactive mode and, upon activation of the installation, arranged to be displaced to a free position by opening the locking device, in which free position the cover is out of the way of said nozzle so that the nozzle may spray extinguishing medium when the spray head is in an active mode, the holder body comprising an inlet (5, 5', 5", 5''') for incoming extinguishing medium, the cover being arranged to be displaced to the free position by a pressure medium exerting a force against the locking device so that it opens (FIGS. 8, 10, 13, 14).

17. Combination according to claim 16, wherein the spray heads (430*a*; 530*a*, 580*a*; 630*a*, 680*a*; 730*a*, 780*a*) are arranged in a number of sections (183*a*, 183*b*; 283*a*, 283*b*; 383) to be activated separately or in groups, each section comprising a number of spray heads (FIG. 10, 13, 14).

18. Combination of a tunnel and an installation for extinguishing fire, wherein a number of spray heads (430*a*, 430*b*; 530*a*, 530*b*; 580*a*) and a pipe system (481; 581) for leading extinguishing medium to the spray heads are provided, the spray heads comprising a holder body (3, 3', 3", 3'''), at least one nozzle (2, 2', 2", 2'''), a cover (13, 13', 13", 13'''), positioned by means of a locking device (14, 17, 14', 17', 14", 17", 14''', 17''') in a protective position in front of said nozzle when the installation is in an inactive mode and, upon activation of the installation, arranged to be displaced to a free position by opening the locking device, in which free position the cover is out of the way of said nozzle so that the nozzle may spray extinguishing medium when the spray head in an active mode, the holder body comprising an inlet (5, 5', 5", 5"') for incoming extinguishing medium, the cover being arranged to be displaced to the free position by a pressure medium exerting a force against the locking device so that it opens (FIG. 17, 19).

19. Combination according to claim 18, wherein part of the spray heads (580*a*, 580*b*) are directed to spray extinguishing medium in the upper part of the tunnel, while the other spray heads (530*a*, 530*b*, 530*ab*) are directed to spray extinguishing medium in an area located more centrally in the tunnel (FIG. 19 to 21).

20. Combination according to claim 18, wherein the spray heads (430*a*, 430*b*; 530*a*, 530*b*; 580*a*) each comprise a displaceable device (6', 6") comprising a projection area, which is arranged to exert the force against the locking device (14', 17', 14", 17") by means of the fluid pressure in a pressure chamber (7', 7"), the pressure chamber being in fluid communication with a control line (45', 45") over a passage (46', 46") in such a way that a pressure of extinguishing medium in the control line is arranged to provide said force against the locking device.

* * * * *